US006744896B2

(12) United States Patent
Tanabe et al.

(10) Patent No.: US 6,744,896 B2
(45) Date of Patent: Jun. 1, 2004

(54) ELECTRET MICROPHONE

(75) Inventors: Haruhisa Tanabe, Yamanashi-ken (JP); Keiji Watanabe, Yamanashi-ken (JP); Koji Takayama, Tokyo (JP)

(73) Assignee: Citizen Electronics Co., Ltd., Fujiyoshida (JP)

( * ) Notice: Subject to any disclaimer, the term of this patent is extended or adjusted under 35 U.S.C. 154(b) by 0 days.

(21) Appl. No.: 10/265,363

(22) Filed: Oct. 7, 2002

(65) Prior Publication Data

US 2003/0068055 A1 Apr. 10, 2003

(30) Foreign Application Priority Data

Oct. 9, 2001 (JP) ..... 2001-311973

(51) Int. Cl.[7] ..... H04R 25/00
(52) U.S. Cl. ..... 381/191; 381/174
(58) Field of Search ..... 381/191, 174, 381/369, 113, 116; 367/170, 181

(56) References Cited

U.S. PATENT DOCUMENTS

2002/0172385 A1 * 11/2002 Tanabe et al.

FOREIGN PATENT DOCUMENTS

EP 1259094 * 11/2002

* cited by examiner

*Primary Examiner*—Sinh Tran
(74) *Attorney, Agent, or Firm*—Dennison, Schultz, Dougherty & MacDonald

(57) ABSTRACT

A back plate having a recess in an underside thereof and a stationary back electrode at a central portion thereof is secured to a substrate, a spacer having an opening is mounted on the back plate so as to form a vacancy between an inside wall of the opening and a periphery of the stationary back electrode. A diaphragm electrode is provided on the spacer. The back plate has vents in the vacancy so as to communicate a space between the back electrode and the diaphragm electrode to a space in the recess of the back plate.

4 Claims, 5 Drawing Sheets

ELECTRET MICROPHONE

BACKGROUND OF THE INVENTION

The present invention relates to a condenser microphone, and more particularly to an electret microphone used for a portable telephone, video camera and others.

FIG. 4 is a sectional view showing a first conventional electret microphone. The electret microphone comprises a substrate 410 mounted on a bottom of a case 500, an annular frame 400, a back electrode 330 mounted on the frame 400, and a vibration film unit 360.

The back electrode 330 comprises a back electrode 310 made of a metallic plate, and an electret layer 320 formed on the back electrode 310. The vibration film unit 360 comprises a vibrating film 340 made of conductive and mounted on the back electrode 330 interposing a spacer 370, and a holding frame 350. The vibrating film 340 and the back electrode 310 compose a condenser.

The vibrating film 340 is vibrated by air entering passing through an opening 260*a* of the case 500. The capacitance of the condenser changes with the vibration of the vibrating film 340 to generate an electric signal. The electric signal is transmitted to an integrated circuit 420 on the substrate 410 to produce an output signal through output electrodes 430 and 440.

FIG. 5 is a sectional view showing a second conventional microphone which is disclosed in Japanese Patent Application Laid Open 2000-50393.

A case part 200 comprises a substrate 210 made of insulation material, a first frame 220, second frame 230, third frame 240, fourth frame 250, and a cover 260, which frames and cover are stacked on the substrate 210 and adhered to each other. The first, second and third frames 220, 230 and 240 are made of ceramic, and the fourth frame 250 is made of metal.

As shown in FIG. 6, each of the frames 220, 230, 240 and 250 has a square shape. On the substrate 210 and first to third frames 220–240, connecting electrodes 210*b*, 220*b*, 230*b* and 240*b* are provided by conductive films, and these electrodes are contacted with each other. Outside sizes of the frames are same, but inside size of the third frame 240 is larger than that of the first and second frames 220 and 230, and the inside size of the fourth frame 250 is larger than that of the third frame 240. Thus, a first shoulder 230*a* and a second shoulder 240*a* are formed on the second frame 230 and on the third frame 240.

Referring to FIG. 5, a microphone part 100 comprises a back electrode 110 made of metal and secured to the first shoulder 230*a*, an electret layer 120 formed on the back electrode 110, a diaphragm electrode 140 mounted on a second shoulder 240*a* of the third frame 240 interposing a lower spacer 150, and an upper spacer 160 between the diaphragm electrode 140 and the cover 260. There is formed vents 111 perforating the back electrode and electret layer 120.

The diaphragm electrode 140 and the back electrode 110 compose a condenser. The diaphragm electrode 140 is vibrated by air entering passing through a sound collecting hole 260*a* of the cover 260. The capacitance of the condenser changes with the vibration of the diaphragm electrode 140 to generate an electric signal. The electric signal is transmitted to an integrated circuit 170 on the substrate 210 through connecting electrodes 210*b*, 220*b* and 240*b*.

In the conventional microphone shown in FIG. 4, since the diameter of the back electrode 310 is equal to the diameter of the vibrating film 340, the capacitance of the capacitor formed by the back electrode and the vibrating film becomes composition of the effective capacitance by the effective area 340*a* of the vibrating film 340 and effective area of the electrode 310 and the stray capacitance by the non-operative portion 340*b* of the vibrating film 340.

Consequently, the sensitivity of the microphone decreases with the increase of the stray capacitance.

In the conventional microphone shown in FIGS. 5 and 6, the entire surface of the back electrode 110 is the effective area and corresponds to the effective area of the diaphragm electrode 140. Therefore, there is no stray capacitance, so that the microphone can be held at high sensitivity.

However, the back electrode 110 is positioned by the second frame 230, and the diaphragm electrode 140 is positioned by the third frame 240. Consequently, it is difficult to hold the accuracy of the distance between the back electrode 110 and the diaphragm electrode 140, since both the members are supported on separate members.

In addition, the vents 111 formed in the back electrode 120 prevent the capacitance to change in proportion to the amplitude of the diaphragm electrode 140. This causes the acoustic characteristics to reduce.

SUMMARY OF THE INVENTION

An object of the present invention is to provide an electret microphone in which a diaphragm electrode film is effectively vibrated, there by improving acoustic characteristics.

There is an electret microphone comprising a substrate having a circuit, a back plate having a recess in an underside thereof and a stationary back electrode at a central portion thereof, and secured to the substrate, an electret layer formed on the stationary back electrode, a spacer having an opening and mounted on the back plate so as to form a vacancy between an inside wall of the opening and a periphery of the stationary back electrode, a diaphragm electrode provided on the spacer, a frame mounted on the diaphragm electrode, the back plate having vents in the vacancy so as to communicate a space between the back electrode and the diaphragm electrode to a space in the recess of the back plate.

The substrate, the back plate and the frame are made of same material.

Each of the substrate, back plate, spacer and frame has a square shape in plan view, the stationary back electrode has a circular shape, four vents are provided between the four corners of the back plate and the periphery of the stationary back electrode.

In an aspect of the invention the vents are provided on a border area of the back electrode.

These and other objects and features of the present invention will become more apparent from the following detailed description with reference to the accompanying drawings.

DETAILED DESCRIPTION OF THE PREFERRED EMBODIMENT

Figure 1:
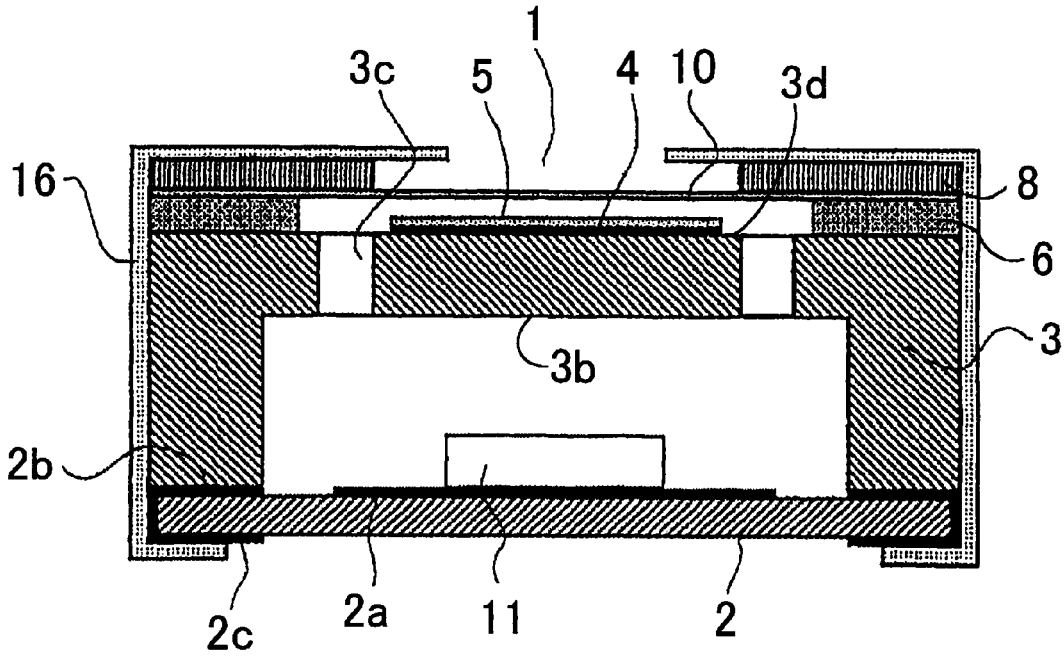
FIG. 1 is a sectional view showing an electret microphone according to a first embodiment of the present invention.
Figure 2:
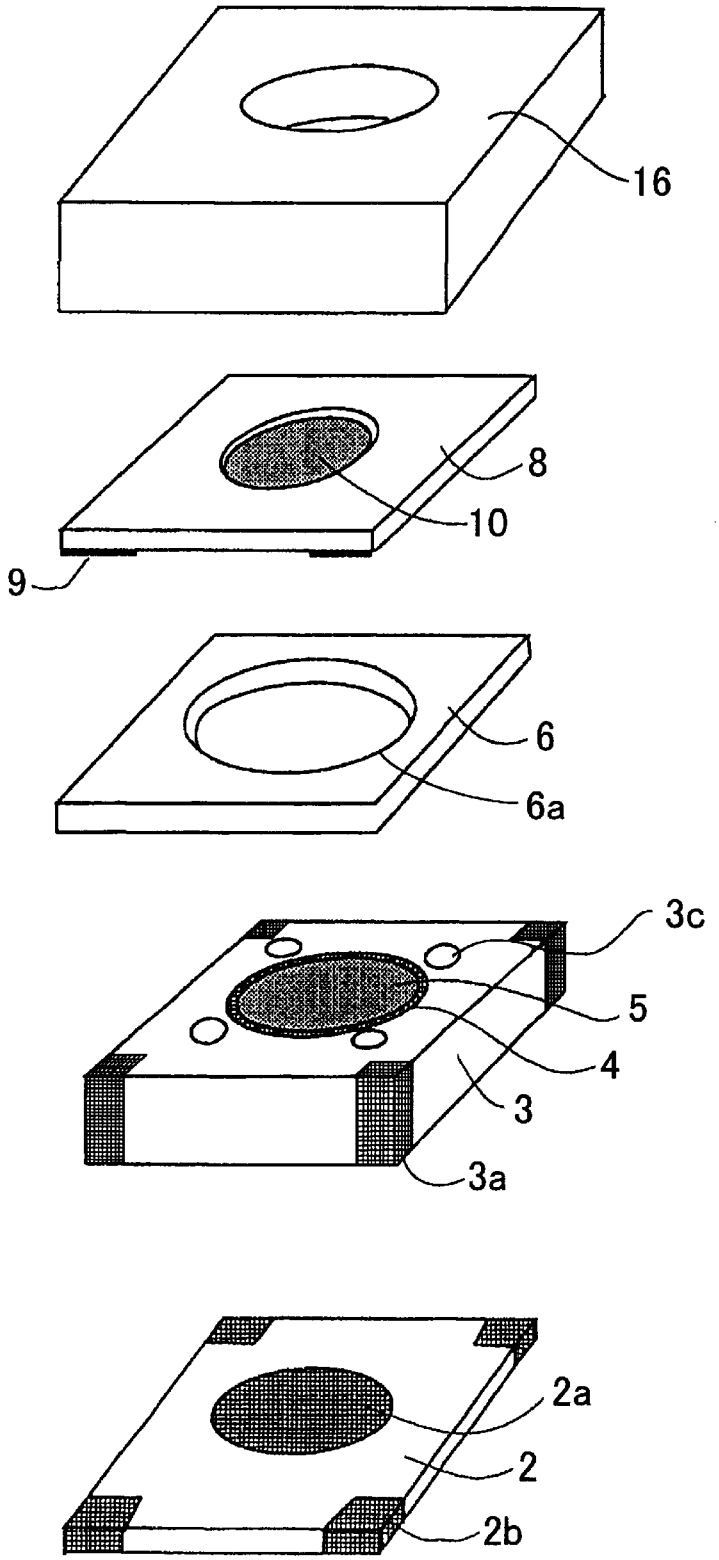
FIG. 2 is an exploded perspective view of the electret microphone.

Referring to FIGS. 1 and 2, the electret microphone according to the first embodiment of the present invention comprises a substrate 2 having a printed circuit 2*a*, connecting electrodes 2*b*, and output electrodes 2*c*, an integrated circuit (IC) 11 securely mounted on the substrate 2, a back plate 3 secured to the substrate 2, a stationary back electrode 4 formed on the surface of the back plate 3, a spacer 6 having an opening 6*a* and secured to the back plate 3, and a frame 8 mounted on the spacer 6. The back plate 3 has connecting electrodes 3*a*, a recess 3*b* provided in the underside thereof for the IC 11 and vents 3*c*.

On the underside of the frame 8, electrodes 9 are formed at corners, and a diaphragm electrode 10 as a movable electrode 10 is formed so as to be connected to the electrodes 9. The substrate 2, back plate 3, frame 8 are made of ceramic or plastic. An electret film 5 is formed on the back electrode 4. Each of the elements 2, 3, 6 and 8 are adhered with adhesive. These elements are covered by a shield case 16. The spacer 6 has an opening so as to form a vacancy 3*d* on the upper surface of the back plate 3 when assembled.

Each of the supporting elements 2, 3, 6, 8 has a square shape in plan view, and each of the back electrode 4 and the diaphragm electrode 10 has a circular shape. The four vents 3*c* are disposed in the vacancy 3*d* at positions between four corners of the back plate 3 and the periphery of the back electrode 4. Thus, the space of the back plate 3 is effectively used, and the size of the device is reduced.

The diaphragm electrode 10 is electrically connected to one of the connecting electrodes 3*a* through the electrodes 9 and a lead (not shown) passing in the spacer 6, and connected to the printed circuit 2*a* through one of the connecting electrodes 2*b*. The back electrode 4 is connected to the circuit 2*a* by the other electrodes 3*a* and 2*b*. Thus, the stationary back electrode film 4 and the diaphragm electrode 10 compose a condenser.

When the diaphragm electrode 10 is vibrated by air entering the frame 8, the capacitance of the condenser changes with the vibration of the diaphragm electrode 10 to generate an electric signal. The electric signal is transmitted to the integrated circuit 11 on the substrate 2 through connecting electrodes 3*a* and 2*b*. The change of air pressure in the chamber of the condenser is absorbed by the space of the recess 3*b* communicated by vents 3*c*, so that diaphragm electrode 10 can be efficiently vibrated.

Figure 3:
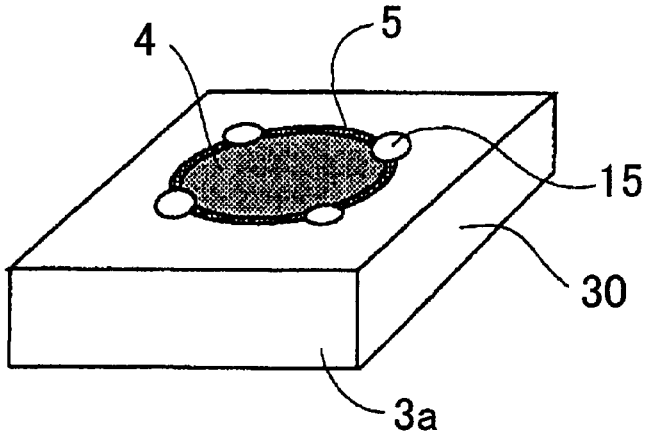
FIG. 3 is a perspective view of a second embodiment of the present invention.
Figure 4:
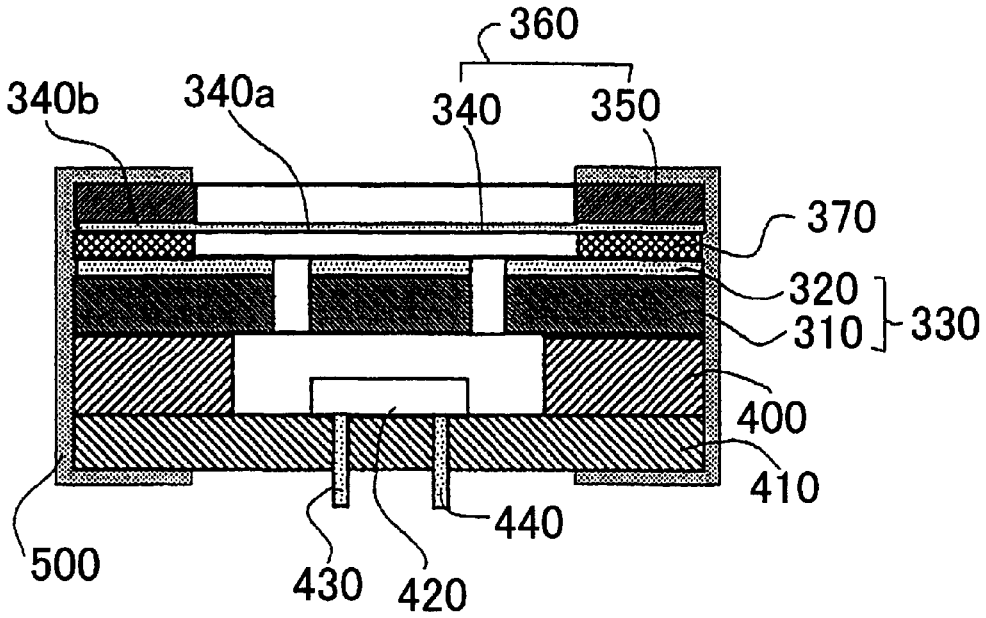
FIG. 4 PRIOR ART
FIG. 4 is a sectional view showing a first conventional electret microphone.
Figure 5:
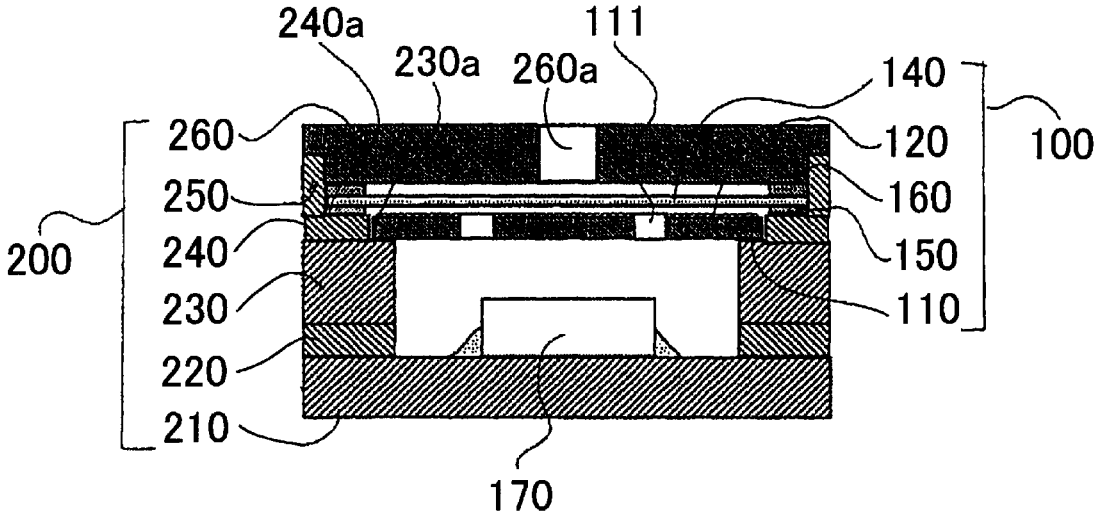
FIG. 5 PRIOR ART
FIG. 5 is a sectional view showing a second conventional electret microphone.
Figure 6:
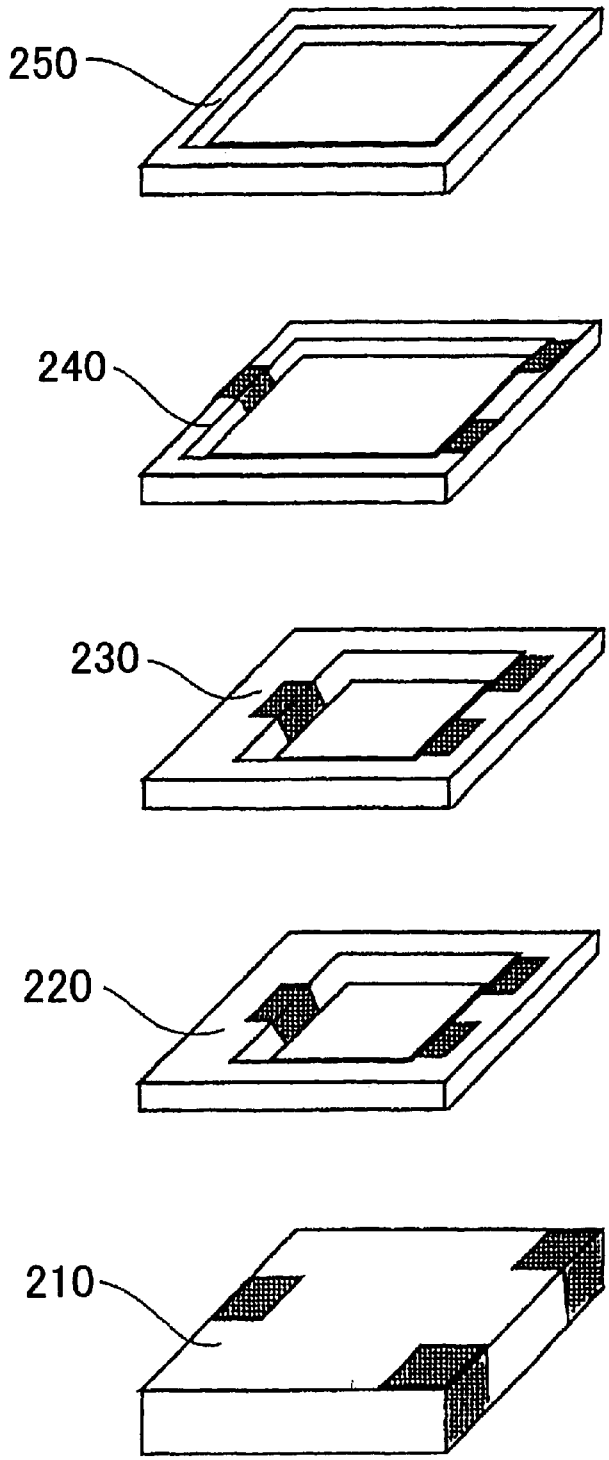
FIG. 6 PRIOR ART
FIG. 6 is an exploded perspective view of the electret microphone.

FIG. 3 is a perspective view showing another embodiment of the present invention. A back plate 30 is different from the back plate 3 of the first embodiment in construction. Other elements are the same as the first embodiment. In the back plate 30, four vents 3*c* are provided on the border area of the back electrode 4. Since the vents 3*c* are located near to the center of the diaphragm electrode 10, the electrode 10 is more effectively vibrated, thereby improving the acoustic characteristics.

While the invention has been described in conjunction with preferred specific embodiment thereof, it will be understood that this description is intended to illustrate and not limit the scope of the invention, which is defined by the following claims.

What is claimed is:

1. An electret microphone comprising:

a substrate having a circuit;

a back plate having a recess in an underside thereof and secured to the substrate;

a stationary back electrode provided on the back plate at a central portion thereof;

an electret layer formed on the stationary back electrode;

a spacer having an opening and mounted on the back plate to form a vacancy on the back plate in a area between an inside wall of the opening and a periphery of the stationary back electrode;

a diaphragm electrode provided on the spacer;

a frame mounted on the diaphragm electrode; and the back plate having vents in the vacancy so as to communicate a space between the back electrode and the diaphragm electrode to a space in the recess of the back plate.

2. The electret microphone according to claim 1 wherein the substrate, the back plate and the frame are made of same material.

3. The electret microphone according to claim 1, wherein each of the substrate, back plate, spacer and frame has a square shape in plan view, the stationary back electrode has a circular shape, four vents are provided between the four corners of the back plate and the periphery of the stationary back electrode.

4. The electret microphone according to claim 1 wherein the vents are provided on a border area of the back electrode.

* * * * *